US007363970B2

(12) United States Patent
Corre et al.

(10) Patent No.: US 7,363,970 B2
(45) Date of Patent: Apr. 29, 2008

(54) EXPANDABLE PACKER

(75) Inventors: Pierre-Yves Corre, Eu (FR); Gilles Carree, Regniere-Ecluse (FR)

(73) Assignee: Schlumberger Technology Corporation, Sugarland, TX (US)

( * ) Notice: Subject to any disclaimer, the term of this patent is extended or adjusted under 35 U.S.C. 154(b) by 74 days.

(21) Appl. No.: 11/257,565

(22) Filed: Oct. 25, 2005

(65) Prior Publication Data

US 2007/0089877 A1 Apr. 26, 2007

(51) Int. Cl.
*E21B 33/12* (2006.01)

(52) U.S. Cl. ..... 166/187; 166/122; 277/331; 277/334

(58) Field of Classification Search ..... 166/122, 166/187; 277/331, 334
See application file for complete search history.

(56) References Cited

U.S. PATENT DOCUMENTS

| | | | | |
|---|---|---|---|---|
| 2,778,432 | A | 1/1957 | Allen | |
| 5,340,626 | A * | 8/1994 | Head | 277/334 |
| 5,579,839 | A | 12/1996 | Culpepper | |
| 5,702,109 | A * | 12/1997 | Mahin et al. | 277/340 |
| 5,839,515 | A | 11/1998 | Yuan | |
| 6,167,963 | B1 | 1/2001 | McMahan | |
| 6,289,994 | B1 | 9/2001 | Willauer | |
| 6,296,054 | B1 | 10/2001 | Kunz | |
| 6,402,120 | B1 | 6/2002 | Swaab | |
| 2003/0075342 | A1* | 4/2003 | Gunnarsson | 166/387 |
| 2003/0098153 | A1 | 5/2003 | Searfin | |
| 2004/0216871 | A1 | 11/2004 | Mendez | |
| 2005/0061520 | A1* | 3/2005 | Surjaatmadja et al. | 166/387 |

FOREIGN PATENT DOCUMENTS

| | | |
|---|---|---|
| EP | 0890706 | 3/2004 |
| GB | 2099541 | 12/1982 |
| GB | 2275066 | 8/1994 |
| GB | 2337064 | 11/1999 |
| GB | 2377959 | 1/2003 |
| GB | 2377960 | 1/2003 |
| GB | 2377961 | 1/2003 |
| GB | 2377962 | 1/2003 |
| GB | 2382364 | 5/2003 |
| WO | 0106087 | 1/2001 |
| WO | 2006030012 | 3/2006 |
| WO | 2006103630 | 10/2006 |

OTHER PUBLICATIONS

Super-Tough Carbon-Nanotube Fibers—A.B. Dalton et al., Nature vol. 423, Jun. 12, 2003, p. 703.

* cited by examiner

*Primary Examiner*—Giovanna C Wright
(74) *Attorney, Agent, or Firm*—Rodney Warfford; David Cate; Jaime Castano

(57) ABSTRACT

An integral bodied composite packer is constructed entirely of a composite material. It can include an expandable middle portion with an elastomeric cover to engage an exterior surface of a well bore. The expandable portion can include continuous strands of polymeric fibers to reinforce the body and prevent extrusion. The packer body can have longitudinal cuts or slats to provide rigidity of the body after expansion. The slats can overlap. The packer can include an elastomeric cover or layer therein to engage the well bore. The expandable portion can include a reinforcement member in a laminar portion of the body made from high strength alloys, fiber-reinforced polymers and/or elastomers, nanofiber, nanoparticle, and nanotube reinforced polymers and/or elastomers.

21 Claims, 2 Drawing Sheets

EXPANDABLE PACKER

FIELD OF THE INVENTION

This invention relates generally to an expandable packer for use in a well bore, and more specifically, to an integral composite expandable packer body where the expandable portion can contain polymeric fibers.

BACKGROUND OF THE INVENTION

Expandable or inflatable packers are well known in the oil industry and have been used for decades. These packers are used to block the flow of fluids through the annular space between the pipe and the wall of the adjacent well bore or casing by sealing off the space between them and are placed in a well bore to isolate different zones of interest or production.

Casing packers can be employed to seal the annular space between the casing and the well bore. Packers can also be set inside the casing to restrict the flow of fluid in the annular space between the casing and production tubing. Packers can be permanent or retrievable. Packers can also be used singly or in combination with other packers to provide sealing engagement within the well bore or casing.

Expandable packers have historically been used for zone isolation, gas/oil ration control, straddle pack services, formation treating, testing and simlar operations. Expandable packers conform to the surface of the open hole and anchor the tool against differential pressure during operation. Expandable packers are especially well suited for setting in uncased holes or in old or pitted casing where slips would cause damage or failure of the surrounding casing. Furthermore expandable packers can seal in larger holes and in rough or irregularly shaped holes where compression type packers of the same nominal size would not otherwise seal.

Typically, expandable packers are inflated by fluid pressure in the tubing. Inflation can be maintained in the single packer by a ball check valve or similar devices. Before expandable packers are run, they are typically filled with liquid and sealed with a plug. In some forms a setting ball may be dropped and tubing pressure applied to set the packer. The pressure may be then increased to shear pins and release the setting ball. Alternatively, pins can be sheared with a sinking bar or a retrievable setting plug may be used. All of these methods of setting expandable packers are well known in the art to which this invention pertains.

Most of the current expandable packers are made with an elastomeric membrane for sealing supported on a metallic structure for mechanical strength. Current expandable packers are assemblies of many different elements such as steel cables, nipples, skirts, and mechanical fibers such as kevlar fibers for anti-extrusion mechanically joined to an elastomeric packer element. The current invention provides an integral composite body allowing the integration of fiber support or metal slats within the integral body to provide extrusion resistance and strength. Since the expansion support is achieved by the laminar location of the support fibers or slats, the mechanical connection to these supporting structures is minimized and the strength of the packer is enhanced.

Often, operators desire to remove a previously set packer to allow access to the well bore. Existing mechanical packer systems can fail to retract after exposure to the high temperatures and pressures of a well bore or production tubing. Another drawback of the existing metallic structure is its susceptibility to corrosion from the fluids encountered in the well bore. The elastomeric membrane in current expandable packers can plastically deform after expansion or break due to excessive bending which may require an anti-extrusion layer between the mechanical reinforcement and the membrane. The present invention with its integral body provides a packer which can be composed of an inner sealing bladder, an integrated mechanical structure, and an outer elastomeric layer for sealing. The support system can be made entirely of a composite material and thus integrates the mechanical support elements within a laminar structure of the composite body.

SUMMARY OF THE INVENTION

An embodiment of the present invention comprises an expandable packer having an integral composite monolithic tubular body having a longitudinal bore therethrough, a non-expandable first end and a non-expandable second end on said integral composite monolithic tubular body, at least one end adapted to be attached to a drill string and unitary with the body, and a central expandable portion of the integral composite monolithic tubular body between the first end and the second end.

Another embodiment of the present invention comprises an expandable packer where the expandable portion provides a laminar elastomeric cover to engage an adjacent surface of a well bore.

Yet another embodiment of the present invention comprises an expandable packer wherein the expandable portion provides continuous strands of polymeric fibers cured within a matrix of the integral composite monolithic tubular body extending from the first end to the second end.

Another embodiment of the present invention comprises an expandable packer where the expandable portion provides an elastomeric laminar layer between the inner diameter of the integral composite monolithic tubular body.

Yet another embodiment of the present invention comprises an expandable packer where the continuous strands of polymeric fibers are bundled along a longitudinal axis of the expandable packer body parallel to longitudinal slits in the expandable body to facilitate expansion.

Another embodiment of the present invention comprises an expandable packer where the central expandable portion contains a plurality of overlapping reinforcement members made from at least one of the group consisting of high strength alloys, fiber-reinforced polymers and/or elastomers, nanofiber, nanoparticle, and nanotube reinforced polymers and/or elastomers.

Yet another embodiment of the present invention comprises an expandable packer where the reinforcement members have an angled end adjacent the non-expandable first end and adjacent the non-expandable second end to allow expansion of the expandable portion of the monolithic tubular body.

Another embodiment of the present invention comprises an expandable packer wherein the angle of the reinforcement end portions is about 54° from the longitudinal axis of the expandable monolithic packer body.

The plurality of overlapping reinforcement members can be slats. Moreover, the expandable packer of another embodiment can provide a central expandable portion of the body having a plurality of longitudinal slits.

An expandable packer of another embodiment can be composed of an integral one-piece composite tubular body having a longitudinal bore therethrough; a non-expandable first end and a non-expandable second end, at least one end adapted to be attached to a drill string; and a central expandable portion of said body between said first end and said second end including a plurality of slat reinforcement members. This embodiment can provide a plurality of slat reinforcement members which are discrete in the central expandable portion of said body and those slats can also be overlapping.

Similarly, in another embodiment of this invention, an expandable packer can be provided comprising a non-metallic monolithic tubular body having a longitudinal bore therethrough; a non-expandable first end and a non-expandable second end on said non-metallic monolithic tubular body, at least one end adapted to be attached to a drill string and unitary with the body; and, a central expandable portion of said non-metallic monolithic tubular body between said first end and said second end. The expandable portion of this embodiment can provide a laminar elastomeric cover to engage an adjacent surface of a well bore; continuous strands of polymeric fibers cured within a matrix of the non-metallic monolithic tubular body extending from the first end to the second end and an elastomeric laminar layer between an outer surface and the inner diameter of the non-metallic monolithic tubular body. The continuous strands of polymeric fibers can be bundled along a longitudinal axis parallel to longitudinal slits in the expandable portion to facilitate expansion and the central expandable portion can contain a plurality of overlapping reinforcement members made from at least one of the group consisting of high strength alloys, fiber-reinforced polymers, and nanofiber, nanoparticle, and nanotube reinforced polymers. The reinforcement members of this embodiment can have an angled end adjacent the non-expandable first end and adjacent the non-expandable second end to allow expansion of the expandable portion of the tubular bodywherein the angle of the reinforcement end portions is about 54° from the longitudinal axis of the expandable packer body.

DETAILED DESCRIPTION OF THE INVENTION

Figure 1:
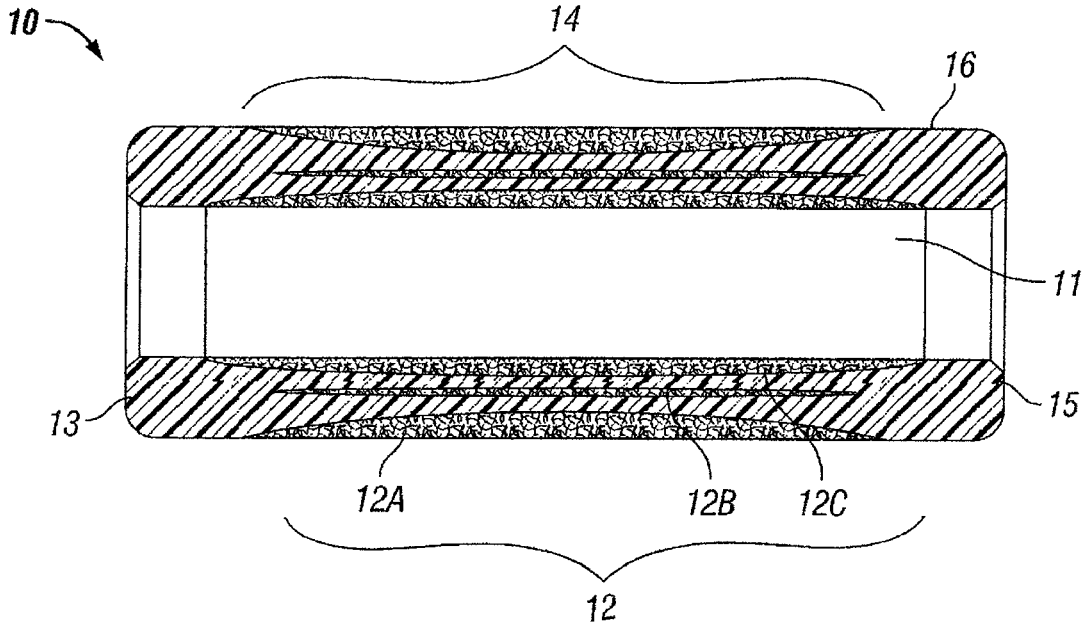
FIG. 1 is a cross-sectional view of an expandable packer where the body is a composite, according to one embodiment of the invention.

Referring to the drawings in detail, FIG. 1 shows an expandable packer 10 with a longitudinal bore 11 therethrough according to one embodiment of the invention. The packer body 16 can be constructed of a composite material or a mixture of composites. The central portion 14 of body 16 can provide one or more laminated elastomeric cells 12 to allow expansion of said portion upon the application of internal fluid pressure. Body 16 can be constructed as a single piece of composite or it can contain multiple sections of composite material that can be layered together before curing and setting of the composite resins. The composite can be fabricated with a plurality of single fibers (not shown) extending from first end 13 to second end 15 longitudinally arranged around the body. The fibers can be positioned during manufacture so there is no mechanical discontinuity between the expandable and non-expandable sections of the packer body 16. These continuous fibers inserted from a first end 13 of the packer to the opposite end 15, provide substantial support to the fully expanded packer.

The expandable portion 14 of the expandable packer 10 is positioned between the first 13 and second 15 non-expandable ends of the body 16. Each end 13 and 15 of the packer body 10 can be adapted to be attached in a tubular string. This can be through threaded connection, friction fit, expandable sealing means, and the like, all in a manner well known in the oil tool arts. Although the term tubular string is used, this can include jointed or coiled tubing, casing or any other equivalent structure for positioning the packer. The materials used can be suitable for use with production fluid or with an inflation fluid.

The embodiment in FIG. 1 shows longitudinal laminations 12*b* formed in the body 16. The expandable packer could also be composed of more than one lamination without departing from the spirit of this disclosure. These laminations allow the packer to expand and the lack of said laminations at the first 13 end and the second end 15 make said ends inexpandable. The shape and angle of the laminations can be fabricated to control the ultimate expanded shape of the packer upon distortion, all in manner well known to those in the composite fabrication art.

The expandable portion 14 can include an elastomeric cover 12*a* to engage an adjacent surface of a well bore, casing, pipe, tubing, and the like. The elastomeric layer 12*b* between the inner and outer portions of the body 16 provides additional flexibility and backup for inner elastomeric surface 12*c*. A non-limiting example of an elastomeric element is rubber, but any elastomeric material can be used. A separate membrane can be used with an elastomeric element if further wear and puncture resistance is desired. A separate membrane can be interleaved between elastomeric elements if the elastomeric material is insufficient for use alone. The elastomeric material of exterior surface 12*a* should be of sufficient durometer for expandable contact with a well bore, casing, pipe or similar surface. The elastomeric material should be of sufficient elasticity to recover to a diameter smaller than that of the well bore to facilitate removal therefrom. The elastomeric material should facilitate sealing of the well bore, casing, or pipe in the inflated state.

The expandable portion 14 of the body 16 can include continuous strands of polymeric fibers cured within the matrix of the integral composite body 16. Strands of polymeric fibers can be bundled along a longitudinal axis of the expandable packer body parallel to longitudinal cuts in a laminar interior portion of the expandable body. This can facilitate expansion of the expandable portion of the composite body 16 yet provides sufficient strength to prevent catastrophic failure of the expandable packer 10 upon complete expansion.

The expandable portion 14 can also contain a plurality of overlapping reinforcement members. These members can be constructed from any suitable material, for example high strength alloys, fiber-reinforced polymers and/or elastomers, nanofiber, nanoparticle, and nanotube reinforced polymers and/or elastomers, or the like, all in a manner known and disclosed in U.S. patent application Ser. No. 11/093390, filed on Mar. 30, 2005, entitled "Improved Inflatable Packers", the entirety of which is incorporated by reference herein.

Figure 2A:
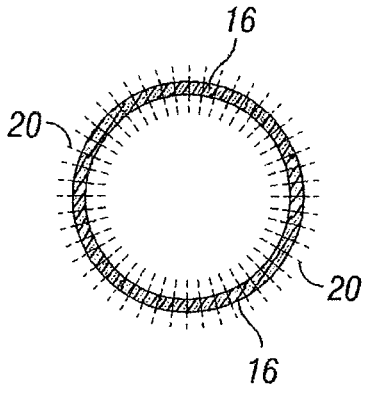
FIG. 2A is a sectional view down the longitudinal axis of the composite body illustrating the longitudinal cuts in the expandable zone, according to one embodiment of the invention.

FIG. 2A is a cross sectional view of the expandable portion 14 of a composite body 16 according to another embodiment of the invention. The composite body 16 shown has longitudinal slits 20 on the expandable portion 14 of the body 16 to allow the expansion of the body 16. Although shown as parallel longitudinal slits 20 that extend the length of the expandable portion 14, the slits 20 can be at any angle, zig-zag, irregularly shaped, or sporadically placed. The slits 20 can be circular, oval, or any other shape that will facilitate the expansion of the body 16. The slits can be parallel to the composite fibers. With the elastomeric elements 12 covering the slits, deformation of the composite body to expand outwardly may be achieved by fluidic pressure applied from an interior longitudinal passage of the expandable packer 10, all in a manner well known in the packer art.

Figure 2B:
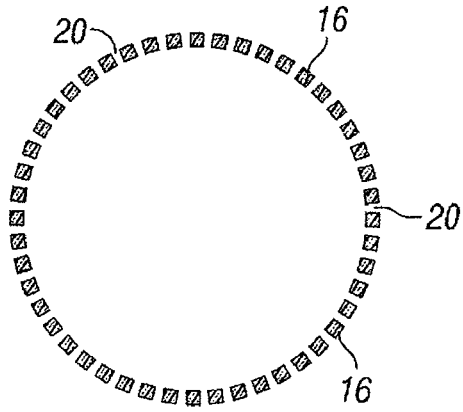
FIG. 2B is a sectional view down the longitudinal axis of the composite body illustrating the longitudinal cuts in the expandable zone of FIG. 2A after expansion of the packer, according to one embodiment of the invention.

FIG. 2B is a cross sectional view of the expandable portion (not the ends) of the composite body of FIG. 2A where the packer has been expanded to cause an expansion of the slits 20. The amount of deformation of the body may be controlled by the spacing or size of the individual longitudinal slits.

Figure 3A:
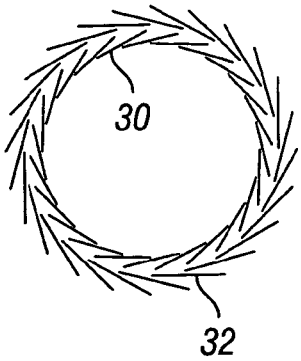
FIG. 3A is a sectional view down the longitudinal axis of the packer illustrating inner and outer reinforcement members in a pre-expansion state in the expandable zone, according to one embodiment of the invention.

FIG. 3A is an alternative to the expandable packer 10 structure of the expandable portion 14 shown in FIGS. 2A and 2B. FIG. 3A is a sectional view down the longitudinal axis of the packer illustrating sets of inner 30 and outer 32 reinforcement members in a pre-expansion state in the expandable zone, according to one embodiment of the invention. Although two sets of members are shown, the invention is not so limited and can have a single or plurality of reinforcement member sets. The reinforcement members can comprise polymeric fibers, or any fiber known in the art that is sufficiently flexible for use in an expandable packer. The expandable composite packer 10 structure with reinforcement members in the expandable portion 14 can be constructed with non-expandable composite ends. The reinforcement members can be laid during the construction of the composite body 16 so as to form a one piece body with reinforcement members contained therein.

Figure 3B:
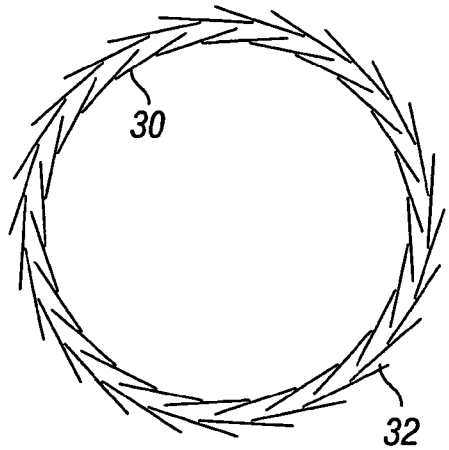
FIG. 3B is a sectional view down the longitudinal axis of the packer of FIG. 3A illustrating inner and outer reinforcement members in a post-expansion state in the expandable zone, according to one embodiment of the invention.

FIG. 3B is a sectional view down the longitudinal axis of the packer illustrating the sets of inner 30 and outer reinforcement members or slats 32 in a post-expansion state in the expandable zone, according to one embodiment of the invention. The reinforcement members can comprise polymeric fibers, or any fiber known in the art that is sufficiently flexible for use in an expandable packer. An anti-extrusion layer can be, but is not necessarily required between an inner elastomeric member and the reinforcement members. Although FIGS. 3A and 3B show the reinforcement members overlapping and shaped as slats, the members do not have to be overlapping nor do the members have to be slat shaped. The slats can be disposed between fibrous mates comprising matrix materials with very low flexural modulus. There can be more than one set of slats. Each set of slats and each individual slat can have a different orientation relative to the bore, i.e., adjacent slats do not have to be parallel.

Figure 4A:
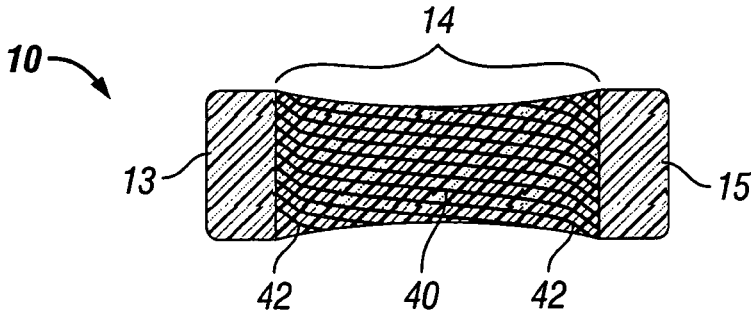
FIG. 4A is a perspective view of an expandable packer with reinforcement members in a pre-expansion state, according to one embodiment of the invention.
Figure 4B:
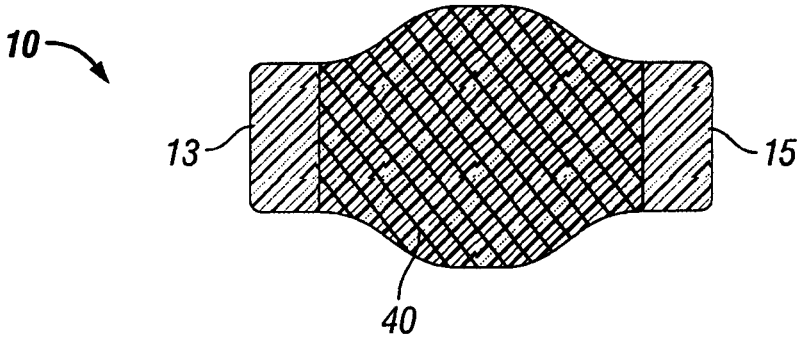
FIG. 4B is a perspective view of the expandable packer of FIG. 4A with the reinforcement members in a post-expansion state, according to one embodiment of the invention.
Figure 4C:
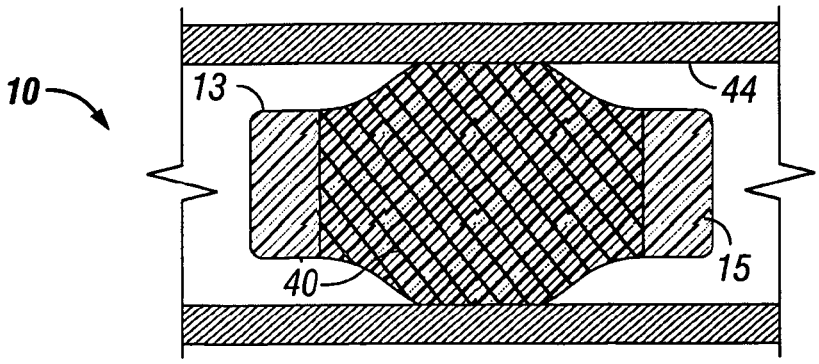
FIG. 4C is a schematic view of the expandable packer of FIG. 4A with reinforcement members in a post-expansion state in a well bore, according to one embodiment of the invention.

FIGS. 4A-4C show a composite body 10 in various states, but an optional outer elastomeric layer is not shown so as to illustrate the orientation of the reinforcement members 40. FIG. 4A is a perspective view of an expandable packer 10 with the reinforcement members in a pre-expansion state, according to one embodiment of the invention. The reinforcement members 40 are located in the expandable portion 14. The reinforcement members have a variable angle 42 which can control the shape of the packer to avoid problems such as ballooning, plastic deformation after expansion or breakage due to excessive bending, etc. This variable angle 42 near the ends limits the amount of expansion of the members. The angled end 42 can be designed to keep the reinforcement members below the elastic limitations of the material. FIG. 4B is a perspective view of the expandable packer of FIG. 4A with the reinforcement members in a post-expansion state, according to one embodiment of the invention. FIG. 4C is a schematic view of an expandable packer with reinforcement members in a post-expansion state sealing a well bore, according to one embodiment of the invention. A tubular string (not shown) can be attached to the packer 10. Although the term well bore is used, the packer can be used with any tube or bore desired to be sealed. The reinforcement members can have an angled end adjacent the non-expandable first end 13 and adjacent the non-expandable second end 15 to allow expansion of the expandable portion of the tubular body. The angle of the reinforcement end portions at angle 42 should be no more than about 54° from the longitudinal axis of the expandable packer body. This angle 42 controls the shape of the packer. This can help control the plastic deformation after expansion and minimizes breakage of the body or the incorporated laminar elastomeric elements 12 due to excessive bending and/or pressure.

The packer is constructed of a composite or a plurality of composites so as to provide flexibility in the packer. Similarly, the central expandable portion 14 of packer 10 can be constructed out of an appropriate composite matrix material, with other portions constructed of a composite sufficient for use in a well bore, but not necessarily requiring flexibility. The composite is formed and laid by conventional means known in the art of composite fabrication. The composite can be constructed of a matrix or binder that surrounds a cluster of polymeric fibers. The matrix can comprise a thermosetting plastic polymer which hardens after fabrication resulting from heat. Other matrixes are ceramic, carbon, and metals, but the invention is not so limited to those resins. The matrix can be made from materials with a very low flexural modulus close to rubber or higher, as required for well conditions. The composite body can have a much lower stiffness that that of a metallic body, yet provide strength and wear impervious to corrosive or damaging well conditions. The composite packer body 10 is designed to be changeable with respect to the type of composite, dimensions, and slat numbers and shapes for differing down hole environments.

To use, the expandable packer is inserted into a well bore by conventional means (for example on a tubular string) adjacent to the area to be sealed. The packer is expanded by fluidic or other means until the desired seal is affected. If desired to be removed, the fluidic or other means are disengaged so at to allow the packer to recover a diameter smaller than that of the well bore to facilitate removal therefrom.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An expandable packer comprising:

an integral composite monolithic tubular body having a longitudinal bore therethrough;

a non-expandable first end and a non-expandable second end on said integral composite monolithic tubular body, integral composite monolithic tubular adapted to be attached to a drill string and unitary with the body; and, a central expandable portion of the integral composite monolithic tubular body between said first end and said second end.

2. The expandable packer of claim 1 wherein the expandable portion provides a laminar elastomeric cover to engage an adjacent surface of a well bore.

3. The expandable packer of claim 1 wherein the expandable portion provides continuous strands of polymeric fibers cured within a matrix of the integral composite monolithic tubular body extending from the first end to the second end.

4. The expandable packer of claim 3 wherein the continuous strands of polymeric fibers are bundled along a longitudinal axis parallel to longitudinal slits in the expandable portion to facilitate expansion.

5. The expandable packer of claim 1 wherein the expandable portion provides an elastomeric laminar layer between an outer surface and the inner diameter of the integral composite monolithic tubular body.

6. The expandable packer of claim 1 wherein the central expandable portion contains a plurality of overlapping reinforcement members made from at least one of the group consisting of high strength alloys, fiber-reinforced polymers and/or elastomers, nanofiber, nanoparticle, and nanotube reinforced polymers and/or elastomers.

7. The expandable packer of claim 6 wherein the reinforcement members have an angled end adjacent the non-expandable first end and adjacent the non-expandable second end to allow expansion of the expandable portion of the monolithic tubular body.

8. The expandable packer of claim 7 wherein the angle of the reinforcement end portions is about 54° from the longitudinal axis of the expandable monolithic packer body.

9. The expandable packer of claim 6 wherein the plurality of overlapping reinforcement members comprise slats.

10. The expandable packer of claim 1 wherein the central expandable portion of the body comprises a plurality of longitudinal slits.

11. An expandable packer comprising:

an integral one-piece composite tubular body having a longitudinal bore therethrough;

a non-expandable first end and a non-expandable second end, at least one end adapted to be attached to a drill string; and a central expandable portion of said body between said first end and said second end including a plurality of slat reinforcement members.

12. The expandable packer of claim 11 wherein the plurality of slat reinforcement members are discrete in the central expandable portion of said body.

13. The expandable packer of claim 12 wherein the plurality of slat reinforcement members are overlapping.

14. An expandable packer comprising:

a non-metallic monolithic tubular body having a longitudinal bore therethrough;

a non-expandable first end and a non-expandable second end on said non-metallic monolithic tubular body, at least one end adapted to be attached to a drill string and unitary with the body; and, a central expandable portion of said non-metallic monolithic tubular body between said first end and said second end.

15. The expandable packer of claim 14 wherein the expandable portion provides a laminar elastomeric cover to engage an adjacent surface of a well bore.

16. The expandable packer of claim 14 wherein the expandable portion provides continuous strands of polymeric fibers cured within a matrix of the non-metallic monolithic tubular body extending from the first end to the second end.

17. The expandable packer of claim 16 wherein the continuous strands of polymeric fibers are bundled along a longitudinal axis parallel to longitudinal slits in the expandable portion to facilitate expansion.

18. The expandable packer of claim 14 wherein the expandable portion provides an elastomeric laminar layer between an outer surface and the inner diameter of the non-metallic monolithic tubular body.

19. The expandable packer of claim 14 wherein the central expandable portion contains a plurality of overlapping reinforcement members made from at least one of the group consisting of high strength alloys, fiber-reinforced polymers, and nanofiber, nanoparticle, and nanotube reinforced polymers.

20. The expandable packer of claim 19 wherein the reinforcement members have an angled end adjacent the non-expandable first end and adjacent the non-expandable second end to allow expansion of the expandable portion of the tubular body.

21. The expandable packer of claim 20 wherein the angle of the reinforcement end portions is about 54° from the longitudinal axis of the expandable packer body.

* * * * *